US009811034B2

(12) United States Patent
Kawabe et al.

(10) Patent No.: US 9,811,034 B2
(45) Date of Patent: Nov. 7, 2017

(54) IMAGE FORMING APPARATUS, IMAGE FORMING METHOD, AND RECORDING MEDIUM STORING IMAGE FORMING PROGRAM

(71) Applicants: Hiroshi Kawabe, Tokyo (JP); Kaori Hemmi, Kanagawa (JP); Keisuke Kubota, Kanagawa (JP)

(72) Inventors: Hiroshi Kawabe, Tokyo (JP); Kaori Hemmi, Kanagawa (JP); Keisuke Kubota, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/226,204

(22) Filed: Aug. 2, 2016

(65) Prior Publication Data

US 2017/0052492 A1 Feb. 23, 2017

(30) Foreign Application Priority Data

Aug. 18, 2015 (JP) ..... 2015-160773

(51) Int. Cl.
*G03G 15/20* (2006.01)
*G03G 15/00* (2006.01)

(52) U.S. Cl.
CPC ..... *G03G 15/5012* (2013.01); *G03G 15/2025* (2013.01)

(58) Field of Classification Search
CPC ..... G03G 15/2025; G03G 15/5012
See application file for complete search history.

(56) References Cited

U.S. PATENT DOCUMENTS

2005/0196183 A1* 9/2005 Taguchi ..... G03G 15/08 399/12
2007/0036575 A1* 2/2007 Hamano ..... G03G 15/50 399/82
2011/0091226 A1* 4/2011 Ishigaya ..... G03G 15/2064 399/33

(Continued)

FOREIGN PATENT DOCUMENTS

JP 2012-063593 3/2012
JP 2014021205 A * 2/2014

(Continued)

*Primary Examiner* — Sevan A Aydin
(74) *Attorney, Agent, or Firm* — Oblon, McClelland, Maier & Neustadt, L.L.P.

(57) ABSTRACT

An image forming apparatus includes an image forming device that forms an image on a sheet, a fixing device including a fixing member that fixes the image formed on the sheet and a polishing device that polishes a surface of the fixing member, and circuitry that determines whether an interruption required operation is to be performed, at a time while image formation is being performed by the image forming device to execute an image forming job, or at a time after image formation is executed for one job and before image formation is to be executed for a subsequent job, controls the image forming device to stop image formation to perform the interruption required operation, based on a determination indicating that the interruption required operation is to be performed, and controls the polishing device to polish the surface of the fixing member concurrently with the interruption required operation.

6 Claims, 10 Drawing Sheets

(56) References Cited

U.S. PATENT DOCUMENTS

| | | | | |
|---|---|---|---|---|
| 2011/0229171 | A1* | 9/2011 | Hirai | G03G 15/0131 399/49 |
| 2012/0069360 | A1 | 3/2012 | Kawa | |
| 2012/0251153 | A1* | 10/2012 | Takada | G03G 15/2028 399/68 |
| 2014/0023386 | A1* | 1/2014 | Takaki | G03G 15/5058 399/38 |
| 2015/0016831 | A1* | 1/2015 | Chiyoda | G03G 15/2025 399/43 |
| 2015/0104205 | A1* | 4/2015 | Moteki | G03G 15/2025 399/43 |
| 2016/0033914 | A1* | 2/2016 | Momma | H01L 27/14625 399/33 |
| 2016/0306306 | A1* | 10/2016 | Nozawa | G03G 15/2053 |

FOREIGN PATENT DOCUMENTS

| | | | | |
|---|---|---|---|---|
| JP | 2014026086 | A | * 2/2014 | |
| JP | 2014199291 | A | * 10/2014 | G03G 15/2017 |
| JP | 2014215376 | A | * 11/2014 | |

* cited by examiner

IMAGE FORMING APPARATUS, IMAGE FORMING METHOD, AND RECORDING MEDIUM STORING IMAGE FORMING PROGRAM

CROSS-REFERENCE TO RELATED APPLICATION

This patent application is based on and claims priority pursuant to 35 U.S.C. §119(a) to Japanese Patent Application No. 2015-160773, filed on Aug. 18, 2015 in the Japan Patent Office, the entire disclosure of which is hereby incorporated by reference herein.

BACKGROUND

Technical Field

The present invention relates to an image forming system, an image forming method, and a non-transitory recording medium storing an image forming program.

Background Art

The known image forming apparatuses form an image on a sheet with such as toner, and fix the formed image with a heat and a pressure, to output a printed sheet. These image forming apparatuses are known to additionally perform post-printing operations such as punching, stapling, and binding etc. on a bundle of printed sheets.

Of these image forming apparatuses, an image forming apparatus is known, which forms images at longer time intervals to ensure time to perform such post-printing operations. During that prolonged time interval, the image forming apparatus also adjusts parameters to maintain quality of forming images. This can reduce a time during which image formation is stopped to adjust parameters, thus improving the overall productivity in printing.

It is also known that the fixing unit that presses the sheet being conveyed through a nip is damaged by edges of the sheet, such that the quality of the formed image deteriorates if the damage is not treated appropriately. To cope with this issue, it is widely known to rub and polish the fixing unit at the appropriate timing to prevent the quality of the formed image from deteriorating.

SUMMARY

Example embodiments of the present invention provide a novel image forming apparatus that includes an image forming device that forms an image on a sheet, a fixing device including a fixing member that fixes the image formed on the sheet and a polishing device that polishes a surface of the fixing member, and circuitry that determines whether an interruption required operation is to be performed, at a time while image formation is being performed by the image forming device to execute an image forming job, or at a time after image formation is executed for one job and before image formation is to be executed for a subsequent job, controls the image forming device to stop image formation to perform the interruption required operation, based on a determination indicating that the interruption required operation is to be performed, and controls the polishing device to polish the surface of the fixing member concurrently with the interruption required operation.

Further example embodiments of the present invention provide a method of processing information and a non-transitory recording medium storing an information processing program.

BRIEF DESCRIPTION OF THE DRAWINGS

A more complete appreciation of the disclosure and many of the attendant advantages thereof will be readily obtained as the same becomes better understood by reference to the following detailed description when considered in conjunction with the accompanying drawings.

Figure 1:
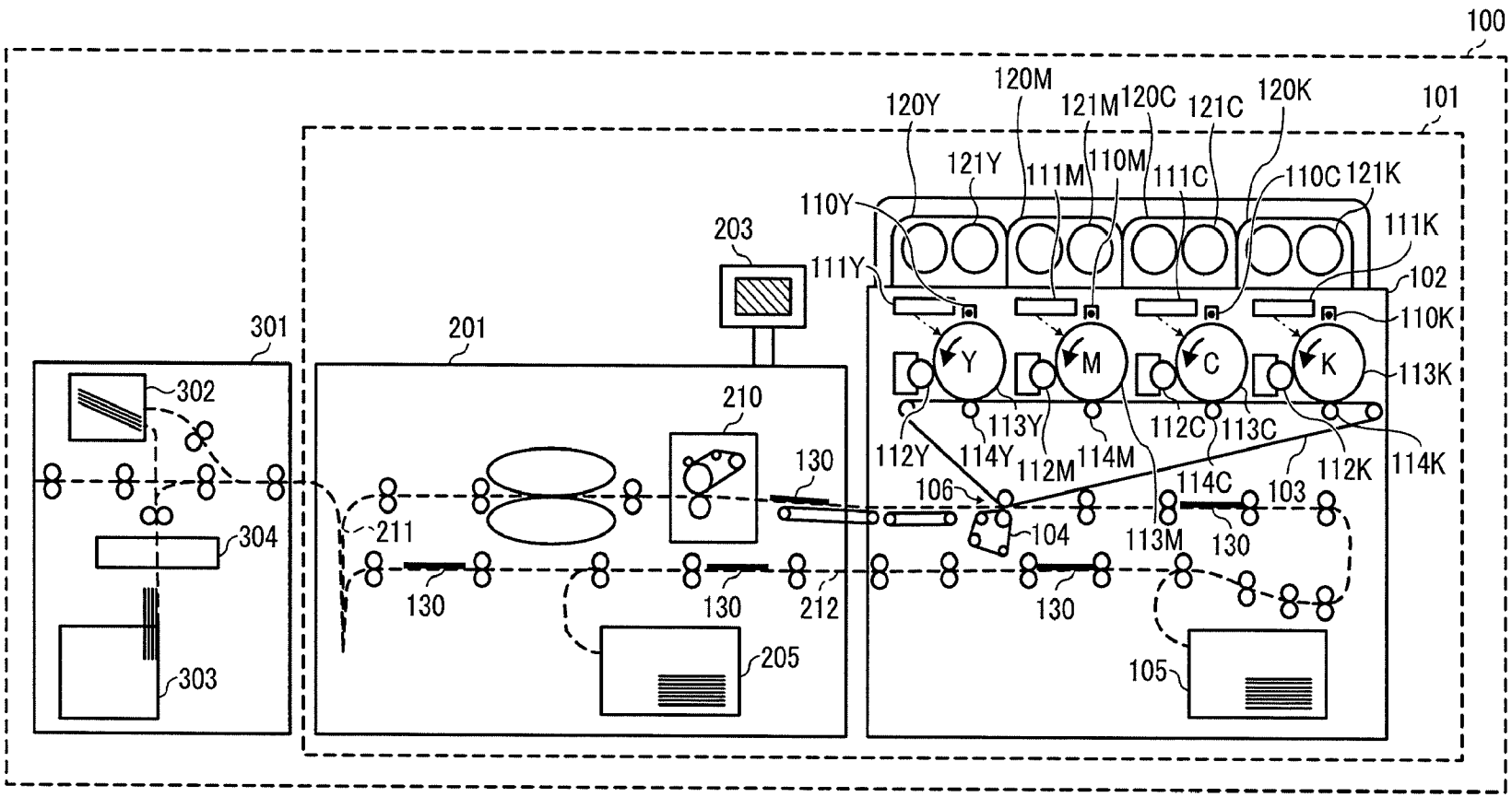
FIG. 1 is a cross-sectional diagram illustrating an image forming system including an image forming apparatus as an embodiment of the present invention.

The accompanying drawings are intended to depict example embodiments of the present invention and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

A more complete appreciation of the disclosure and many of the attendant advantages thereof will be readily obtained as the same becomes better understood by reference to the following detailed description when considered in conjunction with the accompanying drawings.

Embodiments of the present invention are described below in detail with reference to figures. In figures, same symbols are assigned to same or corresponding parts, and their descriptions are simplified or omitted appropriately.

A schematic configuration of an image forming system including an image forming apparatus in this embodiment is illustrated in FIG. 1. FIG. 1 is a cross-sectional diagram illustrating hardware involved with forming an image on a sheet, fixing the formed image, and applying post-processing to the sheet in the image forming system in this embodiment.

The image forming system 100 includes an image forming apparatus 101 and a post-processing apparatus 301.

The image forming apparatus 101 includes an image forming device 102 and a fixing device 201.

The image forming device 102 forms a toner image on the recording paper 130 as a sheet-like recording medium based on the image data. The fixing device 201 fixes the toner image formed by the image forming device 102 on the recording paper 130 by heat and pressure using a fixing rotator.

More specifically, the image forming device 102 includes an intermediate transfer belt 103 in the center portion, and image forming units that form toner images in yellow (Y), magenta (M), cyan (C), and black (K) on the intermediate transfer belt 103 and are arranged side by side along the intermediate transfer belt 103.

Each image forming unit includes a charging unit, 110, an exposure unit 111, a developing unit 112, and a photoconductor drum 113. In FIG. 1, alphabets that indicate a color of the formed image are added at the end of symbols indicating the image forming units described above such as "110Y" etc. However, symbols without alphabet are used in case of describing configurations common to each color.

The photoconductor drum 113 is an image bearer that holds the image formed by the image forming unit. The charging unit 110 is disposed around the photoconductor drum 113 and uniformly charges the photoconductor drum 113. The exposure unit 111 includes a light source that is turned on and off in accordance with the image data and forms an electrostatic latent image of the image based on the image data on the photoconductor drum 113 by scanning the photoconductor drum 113 using the light that the light source emits. The developing unit 112 develops the electrostatic latent image using toner as a developer. It should be noted that the toner used for developing is stored in a toner bottle 121 and supplied by a toner supplier 120.

The toner images in the respective colors formed by the image forming units described above are superimposed one above the other, and transferred onto the intermediate transfer belt 103 by transfer rollers 114Y to 114K corresponding to the respective colors.

The image forming unit 102 and the image fixing unit 201 respectively include a sheet feeder 105 and a sheet feeder 205, to store the recording paper 130 therein. The recording paper 130 is transferred to a nip 106 formed between the intermediate transfer belt 103 and the secondary transfer belt 104, on a feed path indicated by a dash line, by a conveyance roller at the same time when the toner image on the intermediate transfer belt 103 is conveyed to the nip 106. Accordingly, the toner image is transferred from the intermediate transfer belt 103 to the recording paper 130 at the nip 106.

The image forming unit 102 transfers the recording paper 130 to which the toner image is transferred to a fixing unit 210 in the fixing device 201. The fixing unit 210 fixes the toner image by heating and pressing the recording paper 130, such that the toner image having melted toner is adhered to the paper surface. Subsequently, the fixing device 201 transfers the recording paper 130 to the post-processing apparatus 301. In addition, in case of printing on both surfaces of the recording paper 130, the fixing device 201 returns the recording paper 130 on which the image is fixed on a first surface to the image forming unit 102 via a sheet reversing path 211 and a double-sided printing conveyance path 212 to form an image on a back surface using the same operations as the front surface.

The fixing unit 201 further includes a display unit 203, which displays a status of the image forming apparatus 101 etc.

The post-processing apparatus 301 performs post-processing operations such as punching, stapling, and binding etc. on the recording paper 130 that the image has already been printed (fixed). In case of performing post-processing operations, the printed recording paper 130 is stored in a storage unit 302 temporarily. After gathering the recording paper 130 in units of post-processing, the recording paper 130 is transferred to a post-processing unit 304 to perform the post-processing operations. After performing post-processing, the recording paper 130 is ejected and stacked on a stacking unit 303. In case of not performing post-processing, the printed recording paper 130 is ejected through an ejection tray as is.

Figure 2:
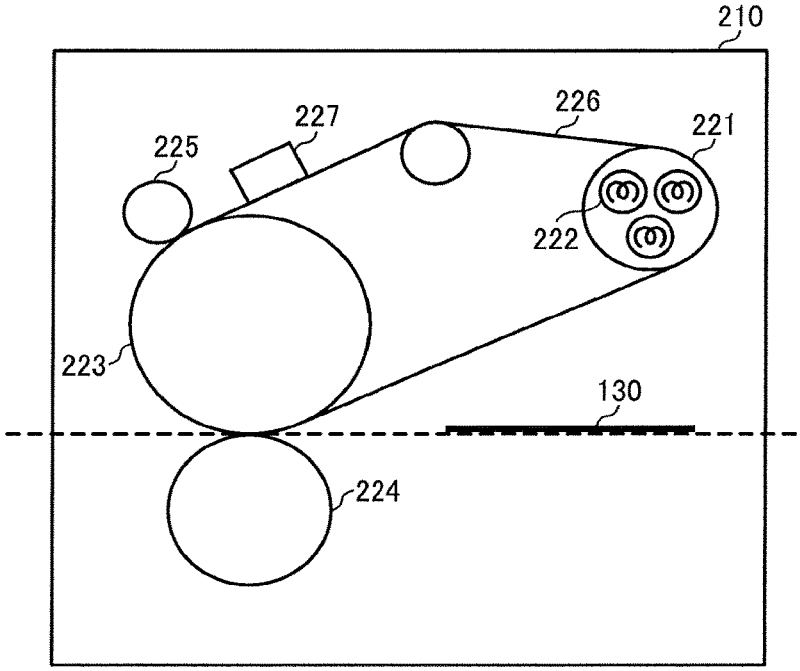
FIG. 2 is a diagram illustrating a configuration of a fixing unit in FIG. 1, as an embodiment of the present invention.

FIG. 2 is a diagram illustrating the fixing unit 210 in FIG. 1 in more detail.

As illustrated in FIG. 2, the fixing unit 210 includes a fixing belt 226 stretched across a fixing roller 223 and a heating roller 221 at a certain tension and a pressure roller 224 that rotates while pressing against the fixing belt 226.

To fix the toner image on the recording paper 130, the fixing unit 210 drives the fixing roller 223 with a driving force applied from the outside, such as a driver, to rotate the fixing roller 223 in the clockwise direction in FIG. 2. The fixing roller 223 contacts the pressure roller 224 via a fixing belt 226 to form a nip with the fixing belt 226, at which the recording paper 130 is sandwiched at the nip. The pressure roller 224 is rotated in the counterclockwise direction in FIG. 2 in the direction that is the same as a direction that the recording paper 130 is ejected.

The fixing unit 210 further includes a heater 222 inside the heating roller 221, which heats the fixing belt 226 to keep a temperature at the nip to be a predetermined temperature. The heater 222 is controlled based on a detection result of a temperature sensor.

After an unfixed toner image is transferred on one side of the recording paper 130, the recording paper 130 is transferred to the nip to be heated and pressed to fix the toner image on the recording paper 130.

The fixing unit 210 further includes a polishing unit 225 that polishes the surface of the fixing belt 226 as the fixing unit to maintain a desired surface property of the fixing belt 226. In polishing, the fixing unit 210 includes a driving unit that rotates the polishing unit 225 while being pressed against the fixing belt 226 at predetermined pressure. The polishing unit 225 rotates in the same direction (or the counter direction) of the rotating direction of the fixing belt 226 at a different linear velocity with the rotation of the fixing belt 226. When polishing is not being performed, the fixing unit 210 controls the driving unit to move the polishing unit 225 to a position away from the fixing belt 226.

A collecting unit 227 collects polishing dust generated by the polishing unit 225 so that the polishing dust does not affect the fixing operation.

Figure 3:
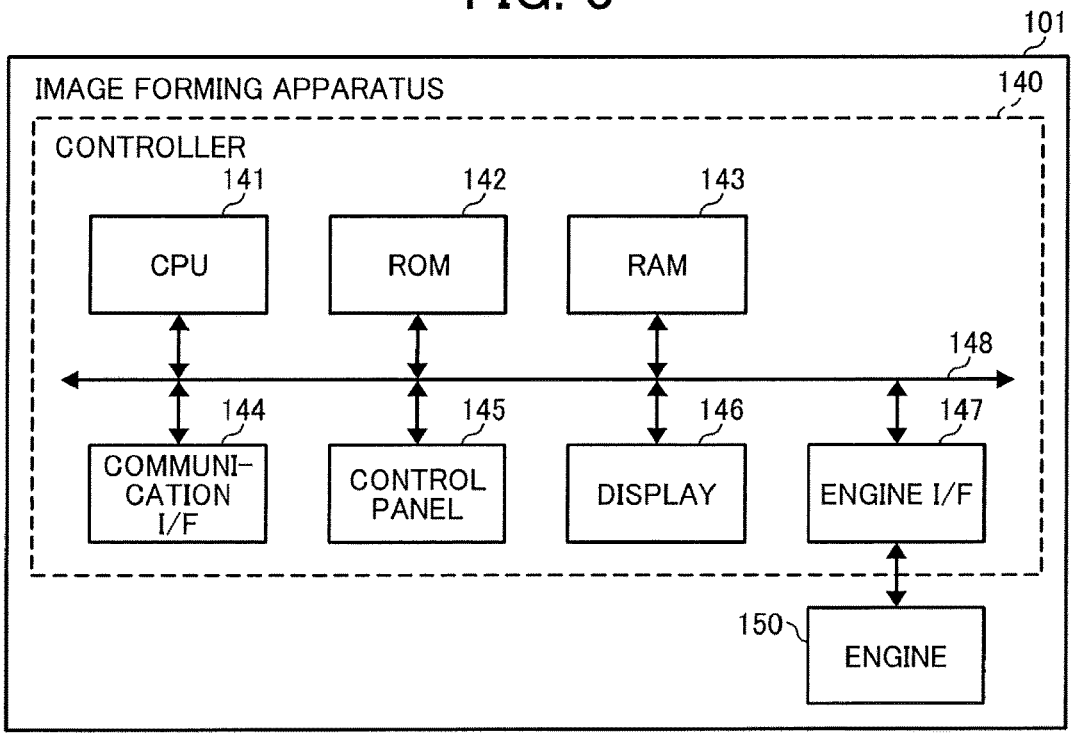
FIG. 3 is a diagram illustrating a hardware configuration of a controller that controls the image processing apparatus in FIG. 1 as an embodiment of the present invention.

FIG. 3 is a diagram illustrating a hardware configuration of a controller 140 that controls the image processing apparatus 101 described above in this embodiment.

As illustrated in FIG. 3, the controller 140 in the image forming apparatus 101 includes a CPU 141, a ROM 142, a RAM 143, a communication interface (IF) 144, a control panel 145, a display I/F 146 (display), and an engine I/F 147, and those components are connected with each other by a system bus 148.

The CPU 141 controls the entire image forming apparatus 101 by executing a program stored in the ROM 142 using the RAM 143 as a work area, and various functions (such as functions described with reference to FIG. 4) can be implemented.

The ROM 142 is a non-volatile storage medium (storing unit) and stores various programs executed by the CPU 141 and various data.

The communication I/F 144 is an interface to communicate with the post-processing apparatus 301 and a print controlling apparatus 401 (described later) etc. It is possible to perform communication using a dedicated network or a public network such as the Internet. It is also possible to adopt any protocol using wired or wireless communication.

The control panel 145 is an operational unit such as various keys, buttons, and a touch panel to accept user operation.

The display I/F 146 displays various information through a display, such as the display device 203 in FIG. 1, such as an operating status, a content of settings, and a message etc. for notification to a user. For simplicity, the display I/F 146 and the display, such as a liquid crystal display and a lamp etc., may be collectively referred to as the display 146 (or the display device 203).

The engine I/F 147 is an interface that connects the engine 150 to the system bus 148 so that the CPU 141 can control the engine 150 through the engine I/F 147.

The engine 150 includes various hardware components to form an image on a sheet and fix the image as illustrated in FIGS. 1 and 2.

The image forming system 100 described above controls a timing and a duration in executing polishing of the fixing belt 226 as the fixing member in the image forming apparatus 101. Those functions are described below in detail.

Figure 4:
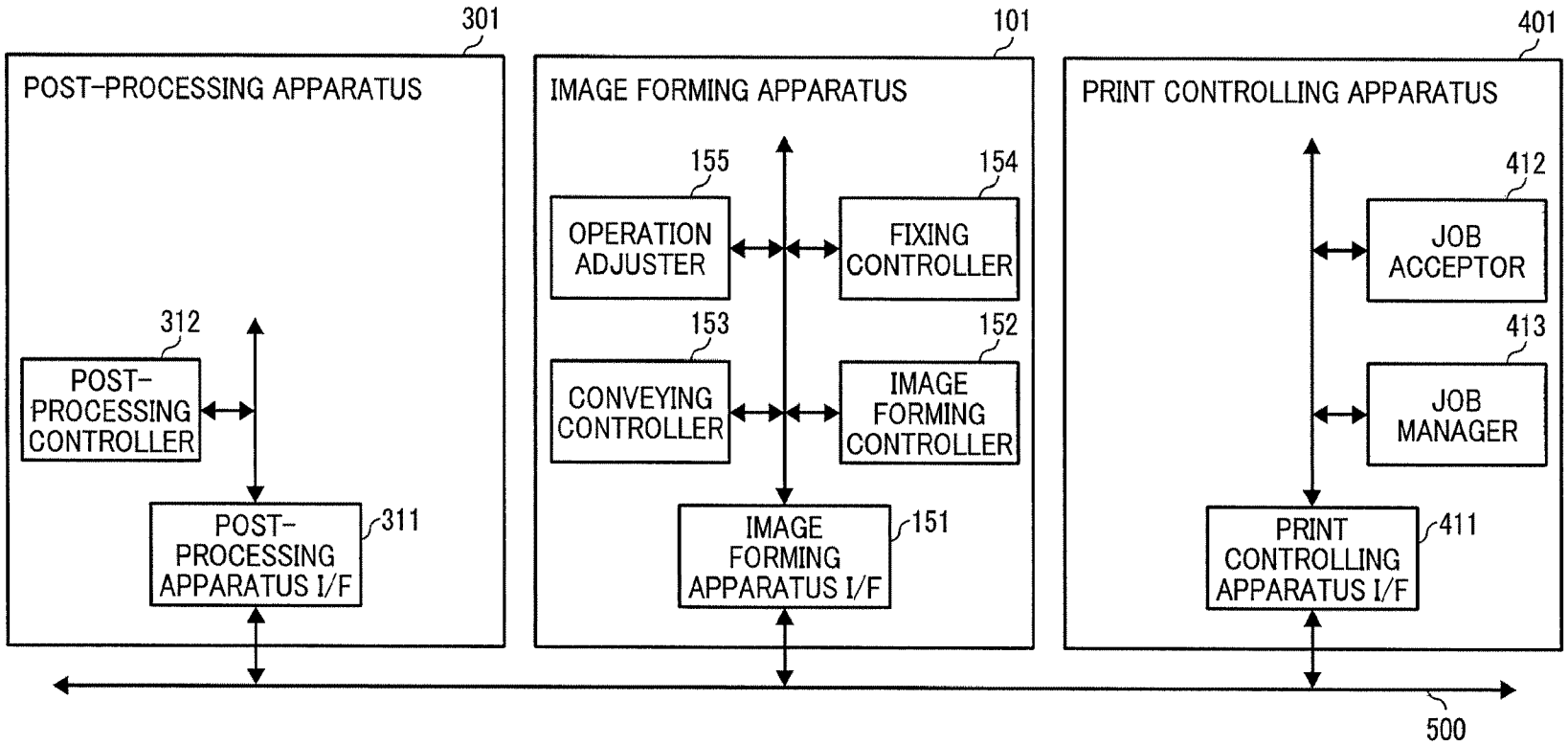
FIG. 4 is a diagram illustrating a functional configuration related to controlling a timing for polishing a fixing belt and a polishing time, included in the image forming apparatus and the peripheral apparatus in FIG. 1.

FIG. 4 is a diagram illustrating a functional configuration of the image forming apparatus 101 and peripheral device, related to controlling the timing and duration of polishing the fixing belt 226. Functions of components in FIG. 4 are achieved by executing a control program with hardware by a processor such as the CPU 141 included in each apparatus.

As illustrated in FIG. 4, the image forming apparatus 101 is connected to the post-processing apparatus 301 and the print controlling apparatus 401 communicable with each other using a communication network 500.

The post-processing apparatus 301 constructs the image forming system 100 along with the image forming apparatus 101.

The print control apparatus 401 accepts, by user operation, designation of a print job to be executed by the image forming system 100 and a command to execute that print job. Required information is transferred to the image forming apparatus 101 and the post-processing apparatus 301 in accordance with the command to execute the print job. Examples of the transferred information are print setting information such as image data of the image to be printed, paper used for printing, the number of printed sheets, whether to perform double-sided printing, and whether or not it is required to perform post-processing and a command to execute the job.

A job acceptance unit 412 includes functions to specify the job described above and accept the command to execute, and a job manager 413 includes a function to manage executing jobs. A print controlling apparatus I/F 411 is an interface that connects the print controlling apparatus 401 to the communication network 500.

The post-processing apparatus 301 includes a post-processing apparatus I/F 311, which is an interface that connects the post-processing apparatus 301 to the communication network 500.

A post-processing controller 312 controls the stacking unit 302 and the post-processing unit 304 etc. to perform post-processing on the recording paper 130 that the fixing unit 201 in the image forming apparatus 101 fixes the image. Since it is required to take a certain amount of time to perform post-processing including paper transfer, even when the bundle of recording paper 130 is stacked to be ready for post processing, post-processing is performed after a predetermined time elapses. As a result, after the certain number of sheets are printed for post processing, the image formation apparatus 101 controls the image forming unit 102 to stop forming an image temporarily at least for an amount of time required for post-processing. This control of stopping image formation is performed by an operation adjuster 155 (described later) based on information acquired from the post-processing controller 312, such as a timing to perform post-processing and an amount of time required for post-processing.

The image forming apparatus 101 includes an image forming apparatus I/F 151, an image forming controller 152, a conveying controller 153, a fixing controller 154, and the operation adjuster 155.

Among these components described above, the image forming apparatus I/F 151 is an interface that connects the image forming apparatus 101 to the communication network 500.

The image forming controller 152 controls image forming units for Y, M, C, and K in FIG. 1 in accordance with image data and print setting information received from the print controlling apparatus 401 to form a toner image on the recording paper 130.

Since printing quality is affected by influence such as deterioration of the photoconductor drum 113 and the developer, and change of environmental conditions etc., in the image forming device 102, it is required to adjust the condition of forming an image regularly to maintain desired image quality. In the adjustment, after a predetermined mark is formed on the intermediate transfer belt 103 by the image forming unit, the sensor reads the predetermined mark, and a parameter value used for determining a condition of forming an image is adjusted based on the read result. In some cases, it is required to repeat this operation for several times until an appropriate read result is acquired. In addition, the image forming controller 152 performs the adjustment by controlling the image forming unit etc.

In addition, to maintain good image quality, it is required to clean the image forming unit and the intermediate transfer belt 103 regularly. The image forming controller 152 also performs the cleaning by using a predetermined cleaning device.

In addition, the image forming controller 152 counts the number of sheets on which an image is formed, the size of sheets, and operating time of the image forming unit etc. and detects a timing that the adjustment and cleaning described above is required. However, since it is required to occupy the image forming unit and the intermediate transfer belt 103 to perform the adjustment and the cleaning, in performing the adjustment and the cleaning, it is required to pause the normal image forming operation (in accordance with the image data) temporarily. Therefore, the adjustment and cleaning are performed not just after it is required to perform the adjustment and cleaning but after the operation adjuster 155 allows to perform the adjustment and cleaning.

In accordance with the print settings received from the print controlling apparatus 401, the conveying controller 153 controls sheet feeding and conveying of the image forming apparatus 101 so that the image forming apparatus 100 appropriately transfers and fixes an image on the recording paper 130.

In accordance with the print settings received from the print controlling apparatus 401, the fixing controller 154 controls the fixing device 201 including the fixing unit 210 so that the fixing device 201 appropriately fixes an image on the recording paper 130.

In the fixing unit 210, the fixing belt 226 is often damaged by edges of the recording paper 130 being transferred, and the image quality of the image formed on the paper 130 is degraded if the damage is left as is. As a result, to maintain good image quality, it is required to scrub and polish the fixing belt 226 using the polishing device 225 at appropriate timing. The fixing controller 154 also performs the polishing by controlling the polishing device 225 and the fixing belt 226.

In addition, the fixing controller 154 counts the number of fixed recording paper 130 taking parameters indicating the damaging degree of the fixing belt 226 such as the size of the recording paper 130, material of the recording paper 130, and thickness of the recording paper 130 etc., acquires the counted value as information indicating the damaging degree of the surface of the fixing belt 226, and detects the timing when it is required to polish based on those values. However, since it is required to perform the polishing by occupying the fixing belt 226, in performing the polishing, it is required to pause the normal fixing operation. In addition, in accordance with that, it is required to stop forming an image by the image forming unit 102 as a preliminarily step of the fixing operation. Therefore, the polishing are performed not just after it is required to perform the adjustment and cleaning but after the operation adjuster 155 allows to perform the adjustment and cleaning. While it is not always required to polish immediately, it is performed to polish in accordance with the command by the operation adjuster 155 in some cases.

It is also possible to acquire the information indicating the damaging degree of the surface of the fixing belt 226 by capturing the surface of the fixing belt 226 and analyzing the image.

In apparatuses connected to the image forming apparatus 101, the operating adjuster 155 adjusts timing of performing an operation by stopping the normal image forming operation temporarily (hereinafter referred to as "interruption required operation"). Examples of the interruption required operation described above are the post-processing, adjusting the image forming condition, cleaning the image forming unit and the intermediate transfer belt 103, and polishing the fixing belt 226 etc. and are not limited to those cases.

Before forming an image on each page and after executing the print job by the image forming device 102, the operating adjuster 155 asks a controller that controls performing the interruption required operation, such as the image forming controller 152, the fixing controller 154, or the post-processing controller 312, if it is required to perform the interruption required operation. When it is required to perform the interruption required operation, the operating adjuster 155 controls to stop forming an image temporarily and allows the controller to perform the interruption required operation. In case of performing the interruption required operation, the operation adjuster 155 also commands the fixing controller 154 to polish the fixing belt 226 simultaneously if possible.

Next, a function and corresponding operation of the operation adjuster 255 and an example of controlling polishing the fixing belt 226 by the fixing controller 154 related to the operation are described below. In the description of each flowchart, the operation adjuster 155 or the fixing controller 154 performs operations in each step. However, actually, the CPU 141 that functions as the operation adjuster 155 and the fixing controller 154 performs these operations.

Figure 5A:
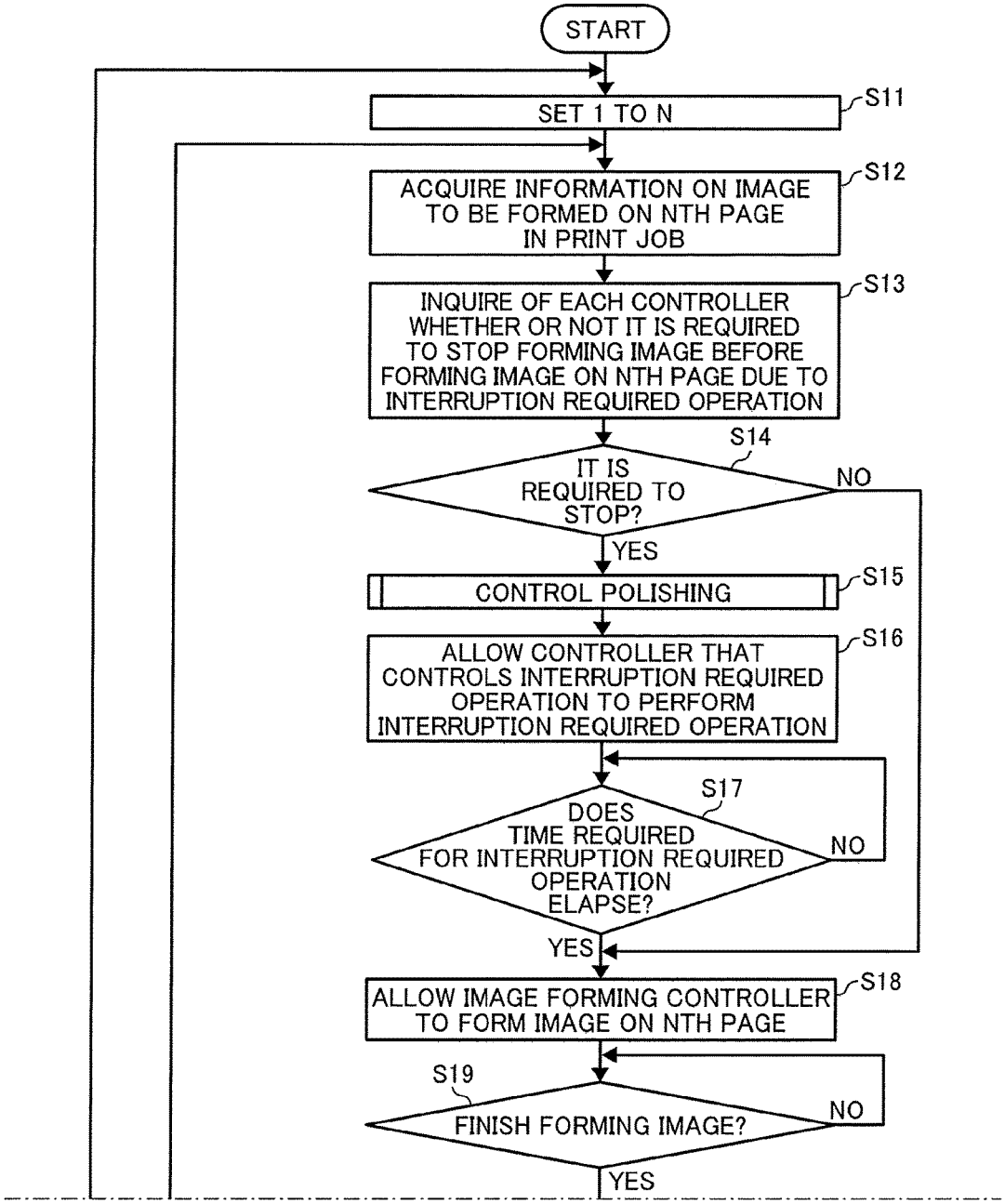
FIGS. 5A and 5B are flowcharts illustrating operation, performed by an operation adjuster in FIG. 4, according to an embodiment.
Figure 5B:
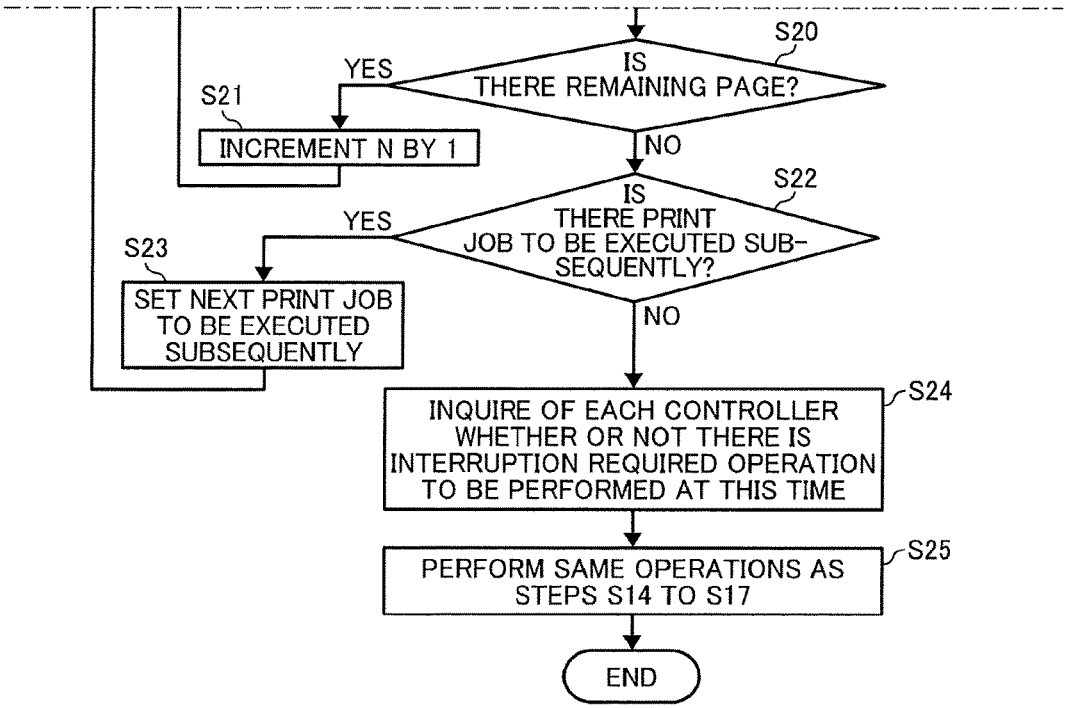

FIG. 5 is a flowchart illustrating an operation performed by the operation adjuster 155.

In response to receiving a command to newly execute a print job while not executing the previously-received print job, the operation adjuster 155 starts the operation illustrated in the flowchart in FIG. 5. In case of further receiving the command to execute a print job while executing the previously-received print job, the newly received print job is registered in a queue and executed after finishing the currently-performed, previously-received print job.

Referring to FIG. 5, first, the operation adjuster 155 sets 1 to variant N indicating on which number of pages an image is to be formed in S11. Subsequently, the operation adjuster 155 acquires information on the image to be formed on the Nth page in the print job in S12. The operation adjuster 155 inquires each controller that controls the interruption required operation whether or not it is required to stop forming an image temporarily before forming an image on the Nth page due to the interruption required operation in S13. For example, the operation adjuster 155 asks the image forming controller 152 whether or not it is required to adjust the conditions of forming an image and clean the image forming device and the intermediate transfer belt 103. In another example, the operation adjuster 155 asks the fixing controller 154 whether or not it is required to polish the fixing belt 226. In another example, the operation adjuster 155 asks the post-processing controller 312 whether or not it is required to perform post-processing. With reference to parameter values, measurement values of sensors, and print settings regarding the current print job etc. managed by each controller, each controller determines whether or not it is required to perform the interruption required operation and answers to the operation adjuster 155 based on the determination.

Figure 6:
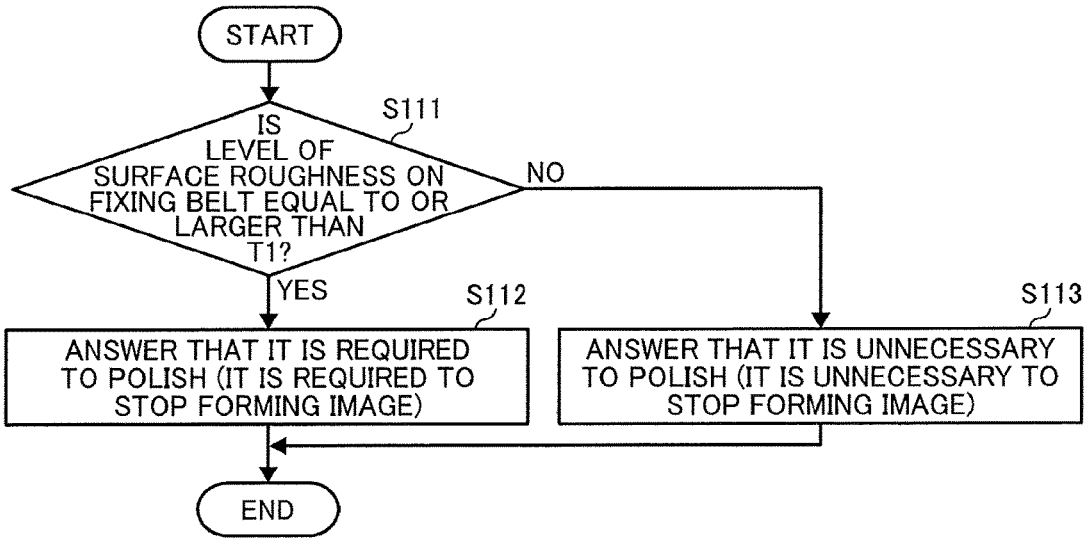
FIG. 6 is a flowchart illustrating an operation of determining whether or not it is required to polish the fixing belt performed by a fixing controller in FIG. 4, according to an embodiment.

FIG. 6 is a flowchart illustrating an operation performed by the fixing controller 154 in response to the inquiry received at S13 of FIG. 5 described above.

After receiving the inquiry on whether or not it is required to polish the fixing belt 226 from the operation adjuster 155, the fixing controller 154 starts the operation illustrated in the flowchart in FIG. 6.

Referring to FIG. 6, first, the fixing controller 154 determines whether or not a surface roughness of the fixing belt 226 is equal to or larger than a predetermined first threshold T1 in S111. If the surface roughness is equal to or larger than T1, the fixing controller 154 determines that it is required to polish, i.e., to stop forming an image temporarily in S112. If the surface roughness is less than T1, the fixing controller 154 determines that it is unnecessary to polish in S113, and the operation ends.

Here, the first threshold T1 is set at a value, which indicates that slight damages that could affect the image quality after fixing are formed on the fixing belt 226 and it is required to polish the fixing belt 226 immediately.

Now, the description goes back to FIG. 5. In response to the inquiry in S13, if there is an answer that it is required to stop forming an image temporarily due to the interruption required operation from any one of the controllers (YES in S14), the operation adjuster 155 performs the polishing control operation in FIG. 7 to determine to polish the fixing belt 226 concurrently during the interruption in S15.

Figure 7:
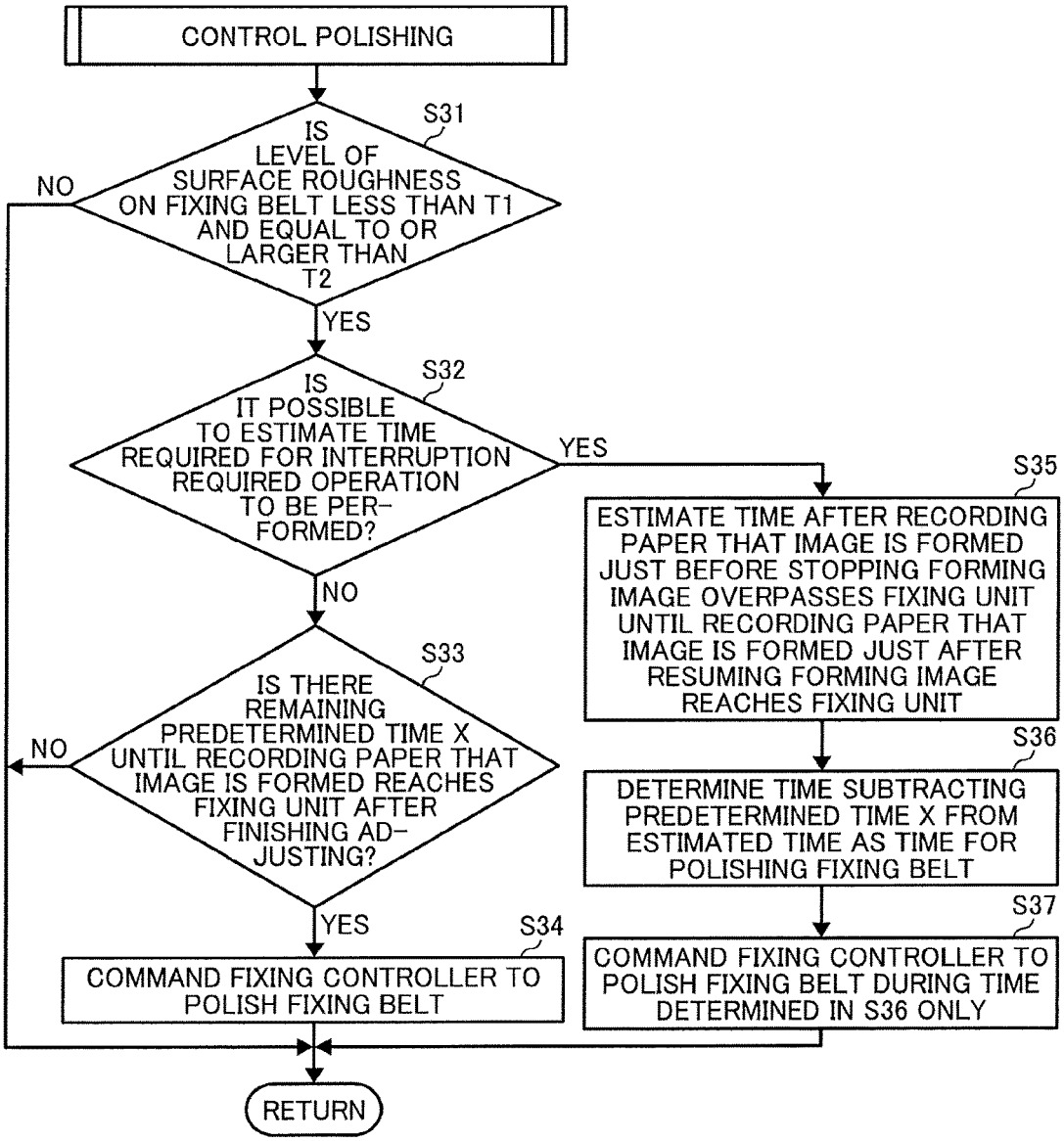
FIG. 7 is a flowchart illustrating an operation of controlling polishing in FIGS. 5A and 5B.

In FIG. 7, first, the operation adjuster 155 determines whether or not the surface roughness of the fixing belt 226 is less that the first threshold T1 and equal to or larger than a predetermined second threshold T2 in S31. Here, the second threshold T2 is set to a value, which indicates that there are fewer damages (roughness) than the condition indicated by the first threshold T1, and the second threshold T2 indicates that damages that could not affect the image quality are formed on the fixing belt 226. As a result, even if the surface roughness becomes equal to or larger than T2, it is unnecessary to polish the fixing belt 226 immediately. However, to prevent the surface roughness from being equal to or larger than T1, here, it is performed to polish the fixing belt 226 only if it is possible to perform to polish the fixing belt 226 concurrently with other interruption required operations after the surface roughness becomes equal to or larger than T2. If the surface roughness is equal to or larger than T1, the polishing is performed as the interruption required operation, so it is excluded to perform the polishing in FIG. 7 to avoid the redundant operation.

As described above, in case of NO in S31, the operation adjuster 155 goes back to the original operation instead of polishing the fixing belt 226. By contrast, in case of YES in S31, in order to perform the polishing, the step proceeds to an operation in S32 and following steps that adjust execution time.

Here, in S32, it is determined whether or not it is possible to predict time required for performing the interruption required operation determined to be executed in S14 in FIG. 5. For example, in case of always performing predetermined operations only such as post-processing, it is possible to predict the execution time. By contrast, if it is usually repeated for several times until an appropriate result is acquired and the repeating times are not determined preliminarily such as adjusting conditions of forming an image.

After that, if it is impossible to predict the execution time (NO in S32), the operation adjuster 155 determines whether or not there is predetermined time X to collect the polishing dust from finishing the interruption required operation until the recording paper 130 on which the image is formed reaches the fixing unit 210 in S33.

After performing the polishing, it is required to take a certain amount of time to collect the polishing dust generated by polishing so that the polishing dust does not affect the image quality. However, if it is impossible to predict the time for performing the interruption required operation, it is impossible to finish polishing earlier than the interruption required operation in expectation of time required for collecting preliminarily. On the other hand, for example, if the interruption required operation is to adjust the condition of forming an image, after finishing the interruption required operation and resuming forming an image, the paper will not reach the fixing unit 210 immediately, and there is a certain amount of time to spare. In the spare time, an image if formed on the intermediate transfer belt 103, the formed image is transferred to the recording paper 130, and the recording paper 130 on which the image is transferred is conveyed from the nip 106 to the fixing unit 210. The amount of spare time depends on sheet conveyance velocity.

As a result, the spare time can be calculated based on the sheet conveyance velocity. If the spare time is longer than the predetermined time X, it is possible to prevent the polishing dust from affecting the fixing operation in case it is finished to polish at the same time of finishing the interruption required operation at least. By contrast, if the spare time is equal to or shorter than the predetermined time X, it is possible not to finish collecting the polishing dust by the time when the recording paper 130 reaches the fixing unit 210 even in case of finishing polishing at the same time of finishing the interruption required operation. As a result, it is possible to affect the fixing operation.

Consequently, in case of YES in S33, the operation adjuster 155 commands the fixing controller 154 to polish the fixing belt 226 in S34, and the operation adjuster 155 returns to the original operation. In this case, the operation adjuster 155 does not command regarding the execution time, and the execution time is managed by the fixing controller 154. In case of NO in S33, it is not performed to polish to prevent from affecting the fixing operation, and it is returned to the original operation of FIG. 5.

On the other hand, in case of YES in S32, the operation adjuster 155 predicts a time period, counted from the time when the recording paper 130 with the image that is formed just before stopping image formation passes the fixing unit 210, to the time when the first paper formed with the first image that is formed just after resuming image formation reaches the fixing unit 210, based on the predicted time required for the interruption required operation and the sheet conveyance velocity in S35. Subsequently, in S36, the execution time of polishing the fixing belt 226 is determined by subtracting the predetermined time X required to collect the polishing dust from the time predicted in S35. After that, in S37, the operation adjuster 155 commands the fixing controller 154 to polish the fixing belt 226 during the execution time determined in S36, and the operation adjuster 155 returns to the original operation of FIG. 5.

In S35 to S37, the operation adjuster 155 commands to polish the fixing belt 226 and collect the polishing dust while there is no recording paper 130 inside the fixing unit 210 in accordance with the execution of the interruption required operation.

Figure 8:
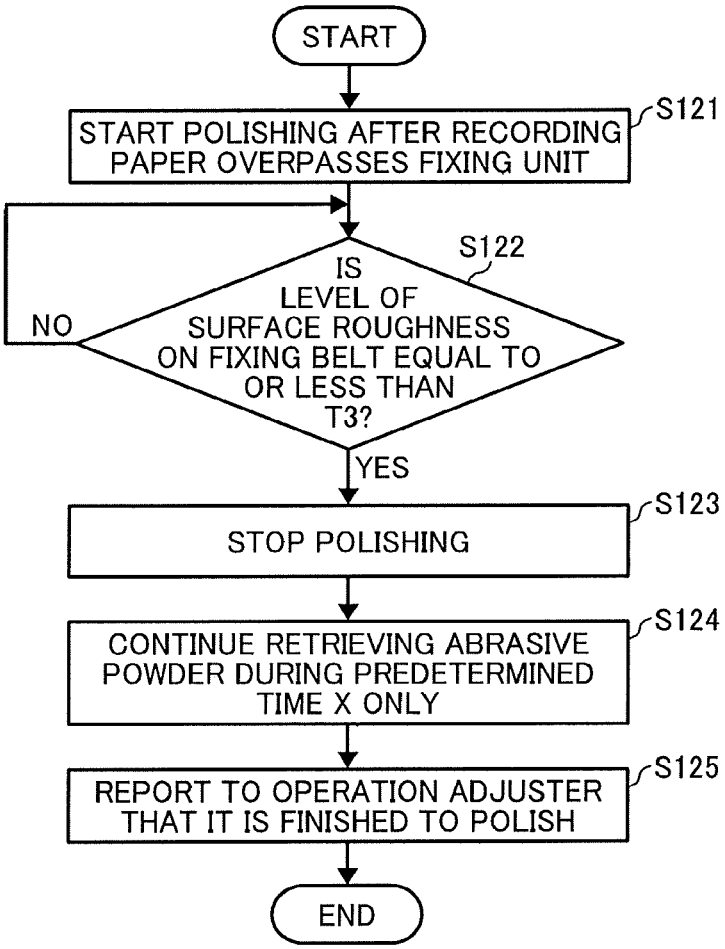
FIG. 8 is a flowchart illustrating an operation performed when the fixing controller receives allowance of execution transferred in S16 in FIG. 5A.

The fixing controller 154 polishes the fixing belt 226 in accordance with the command to execute in S34 or S37 as illustrated in FIG. 8. Here, first, an operation after FIG. 5 is described below.

After S15 in FIG. 5, in accordance with the answer to the inquiry in S13, the operation adjuster 155 allows the controllers that control the interruption required operation to be executed to execute the interruption required operation in S16. Subsequently, the operation adjuster 155 waits during the time required for executing the interruption required operation only in S17. If it is impossible to predict the execution time of the interruption required operation, the operation adjuster 155 waits until the interruption required operation finishes. After that, the operation adjuster 155 allows the image forming controller 152 to form an image on the Nth page in S18.

That is, by the operations in S16 and S17, it is stopped to form an image during the time required to execute the interruption required operation from finishing forming an image on N−1th page to starting forming an image on Nth page. It should be noted that a period that stops forming an image does not always correspond to a period that the controllers allowed to execute in S16 execute the interruption required operation.

For example, if the post-processing is to adjust the condition of forming an image, it is considered that the image formation is not executed at the time of S16, and it is possible that the image forming controller 152 executes immediately. On the other hand, if the interruption required operation is the post-processing operation, the recording paper 130 for the N−1 page to be performed post-processing is located at the image forming device 102 at the time of S16 and does not reach the post-processing apparatus 301, so it is impossible to execute the post-processing operation immediately. To cope with this issue, the operation adjuster 155 stops forming an image so that there is an interval between the recording paper for the N−1th page and the recording paper for the Nth page for the time required for the post-processing operation by waiting in S17. Subsequently, it is possible that the post-processing controller 312 performs the post-processing operation after the recording paper for the N−1 page reaches the post-processing apparatus 301 while the recording paper for the Nth page is conveyed in the interval.

After S18, the operation adjuster 155 waits until it is finished to form an image on the Nth page in S19. After that, if there is subsequent page in the executing print job (YES in S20), after incrementing N by 1 at S21, the operation returns to S12, and the operation for the subsequent page is performed. If there is no subsequent page (NO in S20), it is determined that the currently executing print job is finished, and it is determined whether or not there is a print job to be executed subsequently with reference to a queue in S22. In case of YES in S22, it is considered that the subsequent print job is to be executed in S23. Subsequently, the operation returns to S11, and the operation is repeated. In this case, between forming an image in a print job and forming an image in the subsequent print job, the operations in S13 to S17 are performed.

By contrast, in case of NO in S22, it is determined that it is finished to perform all of the print jobs to be executed at that point. Subsequently, just like the case in S13, the operation adjuster 155 asks each of the controllers whether or not there is an interruption required operation to be executed at this moment in S24. In S25, operations similar to S14 to S17 are performed in accordance with the answer to the inquiry, and the operation in FIG. 5 ends. If it is required to perform the interruption required operation, it is possible to reduce waiting time to execute a subsequent print job by performing the operations in S24 and S25 at the time of finishing the job. Therefore, it is also checked whether or not there is an interruption required operation at this moment.

Figure 9:
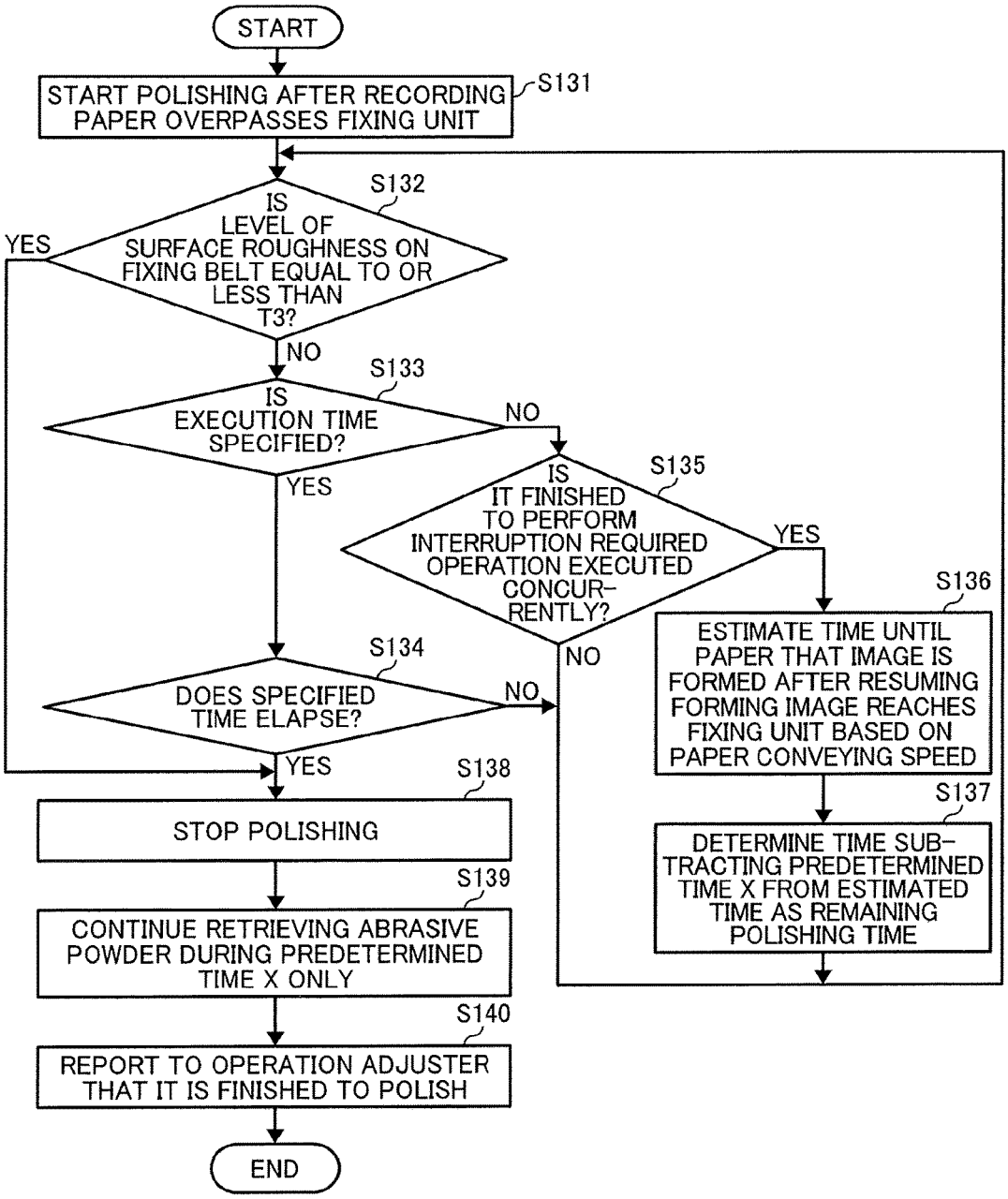
FIG. 9 is a flowchart illustrating an operation performed when the fixing controller receives a command to polish in the operation of FIG. 7.

Next, FIGS. 8 and 9 illustrate an operation of controlling polishing the fixing belt 226 executed by the fixing controller 154.

In FIG. 8, it is performed to polish the fixing belt 226 as the interruption required operation in accordance with the allowance to execute transferred in S16 in FIG. 5.

After detecting the allowance to execute polishing as the interruption required operation, the fixing controller 154 starts the operation illustrated in the flowchart in FIG. 8. Subsequently, after all recording paper 130 on which images have already been formed pass through the fixing unit 210, it is started to polish the fixing belt 226 in S121. This is because it is possible to affect the fixing operation due to the polishing dust if it is performed to polish the fixing belt 226 while the recording paper 130 is passing through the fixing unit 210.

After that, the fixing controller 154 polishes the fixing belt 226 until the surface roughness of the fixing belt 226 becomes equal to or less than a predetermined third threshold T3 in S122. The third threshold T3 is a value indicating that the surface of the fixing belt 226 is smooth enough.

If the surface roughness of the fixing belt 226 decreases and becomes T3, the fixing controller 154 stops polishing in S123. Subsequently, the polishing dust is collected for the predetermined time X described above in S124. After reporting to the operation adjuster 155 that it is finished to polish the fixing belt 226 in S125, and the operation ends.

In this operation, in order to prevent from affecting the image quality in fixing the image, it is stopped to form an image temporarily to sufficiently polish the fixing belt 226. The fixing controller 154 that performs this operation and the operation adjuster 155 that allows the fixing controller 154 to execute this function may be referred to as a second controller.

Referring to FIG. 9, an operation to polish the fixing belt 226 in response to the command to perform polishing, which is transferred in the polishing control operation in FIG. 7, is described.

After detecting the command to execute polishing transferred in S34 or S37 in FIG. 7, the fixing controller 154 starts the operation illustrated in the flowchart in FIG. 9.

In this case, just like the case in FIG. 8, after all recording paper 130 on which images have already been formed pass through the fixing unit 210, the fixing controller 154 starts to polish the fixing belt 226 in S131. Subsequently, just like the case in FIG. 8, if the surface roughness of the fixing belt 226 decreases and becomes equal to or less than the predetermined third threshold T3 (YES in S132), it is stopped to polish the fixing belt 226 in S138. The polishing dust is collected for the predetermined time X in S139. After reporting to the operation adjuster 155 that it is finished to polish the fixing belt 226 in S140, the operation ends.

However, in FIG. 8, in some cases, it is possible to finish polishing the fixing belt 226 even if the surface roughness of the fixing belt 226 is larger than T3. Therefore, in case of NO in S132, the operation proceeds to an operation regarding controlling finishing the polishing. It is performed to polish the fixing belt 226 in accordance with the command to polish using a gap of the recording paper 130 generated by executing the interruption required operations concurrent with other interruption required operations. Therefore, after resuming forming an image, it is required to finish polishing the fixing belt 226 and collecting the polishing dust until the recording paper 130 reaches the fixing unit 210. In the operation after S133, it is finished to polish the fixing belt 226 at an appropriate timing considering that point.

First, if the execution time is specified in the detected command to polish (YES in S133), the fixing controller 154 keeps polishing and finishes polishing at the time when the specified time elapses after starting polishing (YES in S134). In this case, the operation adjuster 155 specifies the appropriate execution time, so it is just possible to follow the command. In addition, in case of specifying remaining execution time in S137, the determination in S133 becomes YES, and the determination in S134 becomes YES after the remaining execution time elapses.

By contrast, if the execution time is not specified (NO in S133), it is kept polishing until at least the currently executing interruption required operation finishes (NO in S135). This operation corresponds to the fact that the operation adjuster 155 does not command to polish if it is impossible to make it in time if it is stopped to polish at the point when the interruption required operation finishes. Subsequently, after finishing the interruption required operation (YES in S123), the fixing controller 154 predicts time until the recording paper 130 on which an image is formed after resuming forming the image reaches the fixing unit 210 in S136. Subsequently, in S137, time subtracting the predetermined time X required to collect the polishing dust from the predicted time is specified as remaining execution time for polishing, and the operation returns to S132 to repeat the operation.

By performing the finishing timing control described above, it is possible to prevent the polishing dust from affecting the fixing operation and polish the fixing belt 226 as long as possible. The fixing controller 154 that performs this operation and the operation adjuster 155 that commands the fixing controller 154 to execute this function may be referred to as a first controller.

It is performed to polish the fixing belt 226 in FIG. 9 using a gap of the recording paper 130 generated if it is required to perform other interruption required operation. Therefore, it is unnecessary to stop forming an image for the polishing, and it is possible to reduce deterioration of printing productivity by polishing the fixing device.

Here, timing of polishing the fixing belt 226 implemented by the operations in FIGS. 7 and 9 is described below with reference to FIG. 10.

Figure 10:
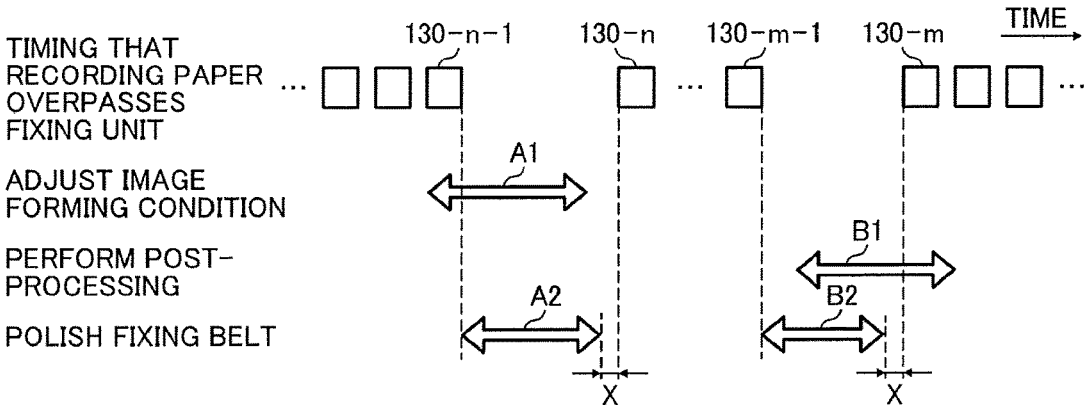
FIG. 10 is a diagram illustrating timings of executing a stop-required operation and polishing the fixing belt.

In FIG. 10, interruption required operations that perform adjustment of conditions of forming an image and post-processing operation sequentially and execution timing of polishing the fixing belt 226 are illustrated. Rectangle marks indicate timing that each recording paper 130 passes through the fixing unit.

In FIG. 10, first, before forming an image on the nth recording paper 130-*n*, the condition of forming an image is adjusted. Since the adjustment of condition of forming an image is performed in the image forming device 102 upstream of the fixing unit 210, the adjustment is started before the n−1th recording paper 130-*n*−1 passes through the fixing unit 210. While it is impossible to predict the execution time preliminarily, the execution time is assumed as a period indicated by arrow A1.

In this case, just before the period indicated by arrow A1, the operation adjuster 155 commands to polish without specifying the execution time in S34 in FIG. 7. In accordance with that, the fixing controller 154 starts the operation in FIG. 9. Subsequently, after the n−1th recording paper 130-*n*−1 passes through the fixing unit 210, it is started to polish the fixing belt 226. In addition, after finishing adjusting the condition of forming an image, the fixing controller 154 predicts time until the nth recording paper 130-*n* on which an image is formed resumed in accordance with the finish reaches the fixing unit 210 and finishes polishing the predetermined time X before that.

In FIG. 10, in order to perform post-processing to the m−1th recording paper 130-*m*−1, an interval corresponding to time required for the post-processing operation is allocated from forming an image on the m−1th recording paper 130-*m*−1 to forming an image on the subsequent mth recording paper 130-*m*. Since the post-processing apparatus 301 downstream of the fixing unit 210 actually performs the post-processing operation, the post-processing is performed during a period indicated by arrow B1 a bit later after the recording paper 130-*m*−1 passes through the fixing unit 210. It should be noted that length of the period required for the post-processing operation can be predicted.

In this case, the operation adjuster 155 commands to polish specifying the execution time in S37 in FIG. 7 at timing a bit before the recording paper 130-*m*−1 passes through the fixing unit 210 (i.e., just after finishing forming an image on the recording paper 130-*m*−1). In response to that, the fixing controller 154 starts the operation in FIG. 9. Subsequently, it is started to polish after the recording paper 130-*m*−1 passes through the fixing unit 210. In addition, in this case, time subtracting the predetermined time X from time from the recording paper 130-*m*−1 passes through the fixing unit 210 to the subsequent recording paper 130-*m* reaches the fixing unit 210 is configured as the execution time. As a result, the fixing controller 154 performs the polishing for the execution time to perform the polishing during a period indicated by arrow B2.

In each case, it is possible to finish polishing including collecting the polishing dust by the time when the subsequent recording paper 130 reaches the fixing unit 210. Therefore, it is possible to prevent the polishing from affecting the quality of fixing an image.

In some cases, it is required to wait to perform the polishing until the surface of the fixing belt 226 becomes smooth enough. This point is described below with reference to FIG. 11.

Figure 11:
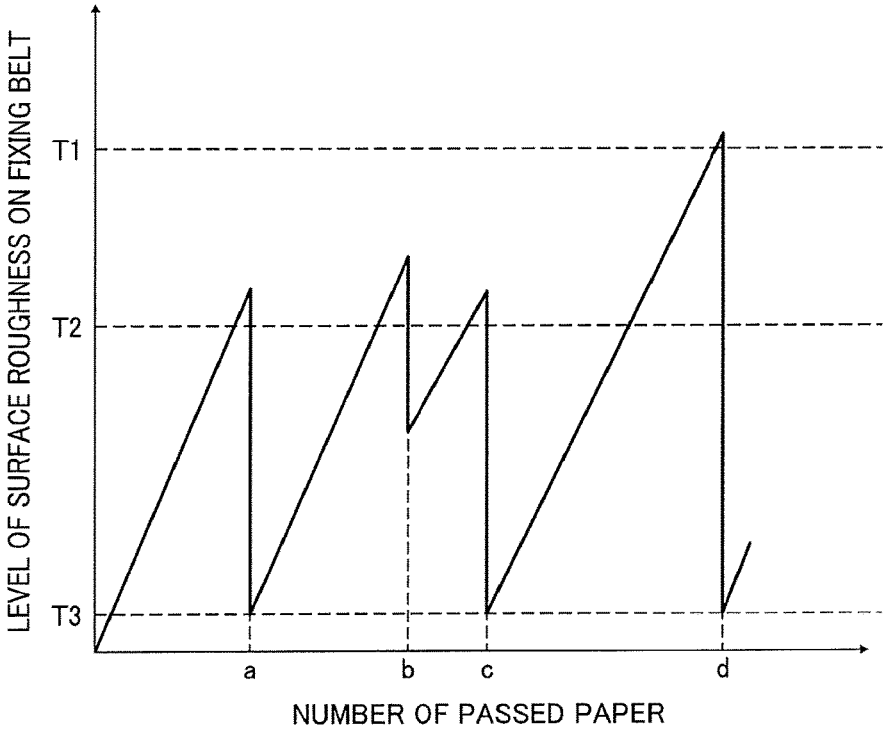
FIG. 11 is a diagram illustrating a change of damage on a surface of the fixing belt in accordance with increasing the number of passing sheets and polishing.

FIG. 11 is a diagram illustrating relationship between the surface roughness of the fixing belt 226 in the fixing unit 210 and the number of passing sheets. In FIG. 11, T1 corresponds to the first threshold, T2 corresponds to the second threshold, and T3 corresponds to the third threshold.

As illustrated in FIG. 11, the surface roughness of the fixing belt 226 becomes larger as the number of passing sheets increases. Actually, an increment per one sheet differs depending on thickness of the sheet, material of the sheet, and the size of the sheet. However, it is assumed that the increment per one sheet is constant in this case. Once the surface roughness increases, it is possible to reduce the surface roughness by polishing as indicated by a to d. The decrement corresponds to the time performing the polishing. Here, a to c correspond to the polishing performed concurrently with other interruption required operation since the surface roughness exceeds T2, and d corresponds to the polishing performed as the interruption required operation itself since the surface roughness exceeds T1.

In FIG. 11, b corresponds to the polishing that polishing cannot be sufficiently performed since the time required for the interruption required operation is short. In this case, while it is impossible to bring back the surface of the fixing belt 226 to the completely smooth status, it is possible to have effect to a certain degree. By reducing the surface roughness as much as possible during that period, it is possible to prevent from stopping forming an image to polish the fixing belt 226 after the surface roughness reaches T1.

On the other hand, since the polishing performed concurrently with other interruption required operations does not affect printing productivity, it is possible to determine whether or not it is possible to execute polishing using T2 that does not affect printing productivity as threshold and polish the fixing belt 226 often.

If the surface roughness could not be brought back to T3 by polishing as indicated by b, it is possible to consider that the polishing is interrupted. In this case, in performing the interruption required operation next time, even if the surface roughness does not exceed T2, it is possible to polish the fixing belt 226 for time shorter than the polishing time fundamentally required at the point of b.

In the embodiment described above, the above-described image forming apparatus prevents the productivity of printing from deteriorating due to the polishing of the fixing unit. Numerous additional modifications and variations are possible in light of the above teachings. It is therefore to be understood that within the scope of the appended claims, the disclosure of the present invention may be practiced otherwise than as specifically described herein.

For example, the image forming apparatus can form not only color images but also monochrome images. In addition, it is possible to consider the post-processing apparatus 301 as a part of the image forming apparatus.

Programs in the embodiments of the present invention instruct the computer to control the hardware to implement the functions of the image forming apparatus 101 described in the embodiments.

It is possible to store these programs in the ROM or other nonvolatile storage media (e.g., flash memory and EEPROM etc.) included in the computer before shipment. However, it is possible to provide those programs by storing those programs in any non-volatile storage medium such as a memory card, CD, DVD, and Blu-ray disc to distribute those programs. By installing those programs stored in those recording media in the computer and executing those programs, it is possible to implement the operations described above.

Furthermore, it is also possible to download those programs from an external apparatus that includes the recording medium storing those programs or an external apparatus that stores those programs in a storage unit and install those programs in the computer to execute those programs. Furthermore, elements and/or features of different illustrative embodiments may be combined with each other and/or substituted for each other within the scope of this disclosure and appended claims.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

The invention claimed is:

1. An image forming apparatus comprising:

an image forming device configured to form an image on a sheet;

a fixing device including a fixing member to fix the image formed on the sheet and a polishing device to polish a surface of the fixing member; and circuitry configured to:

determine whether an interruption required operation is to be performed, at a time while image formation is being performed by the image forming device to execute an image forming job, or at a time after image formation is executed for one job and before image formation is to be executed for a subsequent job, control the image forming device to stop image formation to perform the interruption required operation, based on a determination indicating that the interruption required operation is to be performed, control the polishing device to polish the surface of the fixing member concurrently with the interruption required operation;

acquire information indicating a surface roughness of the fixing member, and control the polishing device to polish the surface of the fixing member concurrently with the interruption required operation in response to the acquired surface roughness exceeding a second threshold that is less than a first threshold, the first threshold causing the polishing device to polish the surface of the fixing member after stopping image formation.

2. The image forming apparatus according to claim 1, wherein the circuitry is further configured to control the polishing device to start polishing the surface of the fixing member, after a first sheet passes the fixing device, the first sheet having an image formed just before stopping of image formation, and finish polishing the surface of the fixing member, a time that is a predetermined time before a time when a second sheet reaches the fixing device, the second sheet having an image formed just after resuming of image formation.

3. The image forming apparatus according to claim 1, wherein the interruption required operation includes an adjustment of a condition of forming an image using the image forming device.

4. The image forming apparatus according to claim 1, wherein the interruption required operation includes a post-processing operation on the sheet having the image fixed by the fixing device, performed by a post-processing device.

5. A method of controlling image formation performed by an image forming apparatus, the method comprising:

determining whether an interruption required operation is to be performed, at a time while image formation is being performed by an image forming device to execute an image forming job, or at a time after image formation is executed for one job and before image formation is to be executed for a subsequent job;

controlling the image forming device to stop image formation to perform the interruption required operation, based on a determination indicating that the interruption required operation is to be performed;

controlling a polishing device to polish a surface of a fixing member concurrently with the interruption required operation;

acquiring information indicating a surface roughness of the fixing member; and controlling the polishing device to polish the surface of the fixing member concurrently with the interruption required operation in response to the acquired surface roughness exceeding a second threshold that is less than a first threshold, the first threshold causing the polishing device to polish the surface of the fixing member after stopping image formation.

6. A non-transitory, computer-readable recording medium storing a program that, when executed by one or more processors of an image forming apparatus, causes the processors to implement a method of forming an image, comprising:

determining whether an interruption required operation is to be performed, at a time while image formation is being performed by an image forming device to execute an image forming job, or at a time after image formation is executed for one job and before image formation is to be executed for a subsequent job;

controlling the image forming device to stop image formation to perform the interruption required operation, based on a determination indicating that the interruption required operation is to be performed;

controlling a polishing device to polish a surface of a fixing member concurrently with the interruption required operation;

acquiring information indicating a surface roughness of the fixing member; and controlling the polishing device to polish the surface of the fixing member concurrently with the interruption required operation in response to the acquired surface roughness exceeding a second threshold that is less than a first threshold, the first threshold causing the polishing device to polish the surface of the fixing member after stopping image formation.

* * * * *